United States Patent [19]

Smith et al.

[11] 3,966,619

[45] June 29, 1976

[54] LUBRICANTS FOR COLD WORKING OF ALUMINIUM

[75] Inventors: Gordon Frederick Smith, Rugby; Michael Keith Budd, Barford St. Michael, both of England

[73] Assignee: Alcan Research and Development Limited, Montreal, Canada

[22] Filed: Oct. 28, 1975

[21] Appl. No.: 626,269

[30] Foreign Application Priority Data

Nov. 5, 1974 United Kingdom ..... 47694/74

[52] U.S. Cl. ..... 252/32.5; 72/42; 252/49.3; 252/389 A

[51] Int. Cl.[2] ..... C10M 1/44; C10M 3/38; C10M 5/24; C10M 7/24

[58] Field of Search ..... 252/32.5, 49.3, 389 A; 72/42

[56] References Cited

UNITED STATES PATENTS

| | | | |
|---|---|---|---|
| 3,574,100 | 4/1971 | Wetmore | 252/32.5 |
| 3,718,588 | 2/1973 | Bellos et al. | 252/32.5 |
| 3,728,260 | 4/1973 | Flowerday et al. | 252/32.5 |
| 3,819,647 | 6/1974 | Foley | 252/32.5 |

*Primary Examiner*—Delbert E. Gantz
*Assistant Examiner*—I. Vaughn
*Attorney, Agent, or Firm*—Cooper, Dunham, Clark, Griffin & Moran

[57] ABSTRACT

A lubricant for working aluminium comprising essentially an aqueous solution of a. a secondary alkylamine, in which at least one of the alkyl groups includes a chain of at least 8 carbon atoms, the secondary alkylamine including a carboxylic acid group as a substituent at a carbon atom not more than 3 atoms distant from the amino group and b. an acid phosphate mono- or di- ester of a polyalkylene oxide surface active agent, said alkylamine and said acid phosphate ester each having a solubility of at least ½% by weight in water and said solution including at least ½% by weight of said alkylamine and said acid phosphate ester.

8 Claims, No Drawings

LUBRICANTS FOR COLD WORKING OF ALUMINIUM

The present invention relates to lubricants for use in working aluminium.

In rolling aluminium a liquid is used to flood the rolls and the aluminium strip. This fluid has two functions: (a) to act as a heat transfer medium to remove the heat of friction and deformation, (b) to protect the surface of the rolled metal from direct contact with the rolls. In modern highly-powered equipment, increased rates of productivity can be attained by increasing rolling speed and/or by increasing the reduction taken in one pass. Both approaches put increased demands on the rolling fluid, as they lead to an increase of the rate of deformation and consequently to increased demands in terms of both cooling and surface protection.

A rolling lubricant, based on mineral oil in cold rolling aluminium, has severe limitations as a heat transfer medium because 1. the specific heat is only 0.5 kcal/kg as opposed to 1 kcal/kg in the case of water,
2. viscosity of the lightest mineral oil usable in practice (1.7 cp) (30–40 secs. Redwood No. 1 at 100°F) is almost double that of water (1 cp) (about 25 secs. Redwood No. 1 at 100°F),
3. latent heat of vaporisation of mineral oils cannot be effectively utilised because of their high boiling points (over 200°C), and
4. the fire hazard of mineral oils increases at high rolling speeds and reductions because higher local temperatures are reached as a result of high work input. Mist and spray formations increase at high speeds.

For these reasons, in cold rolling aluminium speeds over 3000–4000 ft/min. coupled with simultaneous reductions over 60% per pass are not attainable on a production basis, using lubricants based on mineral oils.

The use of water-based lubricants in rolling is extensively applied in the metal industry but the problems associated with the reactivity of a freshly exposed aluminium surface with water have restricted the application of water-based lubricants in the cold rolling of aluminium.

In order to overcome this difficulty the present invention provides an aqueous composition containing a water soluble load-bearing component and having functional groups which become strongly adsorbed at both anodic and cathodic sites on the aluminium strip surface.

The present invention provides a lubricant for rolling aluminium comprising essentially an aqueous solution of an adduct of (a) a secondary alkylamine, in which at least one of the alkyl groups includes a chain of at least 8 carbon atoms, the secondary alkylamine including a carboxylic acid group as a substituent at a carbon atom not more than 3 carbon atoms distant from the amino group, and (b) an acid phosphate mono- or di-ester of a polyalkylene oxide surface active agent in an amount of at least ½% by weight of said alkylamine and ½% by weight of said phosphate mono- or di-ester. For suitability for the lubricant of the invention both the alkylamine and acid phosphate ester must be soluble in water in an amount of at least ½% by weight.

The carboxylic acid group performs the function of solubilising the secondary amine which is preferably an amino acid of the general formula $R_1 - NH - R_2COOH$ wherein $R_1$ is an alkyl group containing a chain of at least 8 carbon atoms and $R_2$ is an alkyl group containing up to 5 carbon atoms. The load-bearing capacity of the amino acid may be further improved by the introduction of aryl or alkyl or alkenyl substituents into $R_1$. The solubilisation of the amino acid may be improved by the introduction of one or more hydroxyl groups as substituents into $R_1$ or into the aryl or alkyl substituents of it. Suitable amino acids may contain one or more alkoxy groups as substituents in $R_1$ in addition to or in place of a hydroxy group or groups. The amino group of the amino acid component of the adduct is adsorbed onto the cathodic sites on the aluminium and serves to protect those sites.

The composition also includes at least ½% of a water soluble acid phosphate mono- or di-ester of a polyalkylene oxide surface active agent. A very wide range of such phosphate esters have already been described in the art in for example British Pat. Nos. 1,081,285 and 918,430. The substances therein described are useful for the present purpose provided that they exhibit a solubility of at least ½% by weight in aqueous solution. These phosphate esters have been described as being used in lubricants. In the present invention however they are incorporated in the composition to form an adduct with the alkylamine, the adduct acting as a corrosion inhibitor at the anodic sites on the aluminium in addition to performing a function as a load-bearing substance through the presence of the alkylamine component.

In the phosphate mono- or di-ester the ester radical preferably is of the form $R_3-O(CH_2CH_2O)_n-$, in which $R_3$ is an alkyl, aryl, aralkyl, alkaryl, alkenyl, alkenaryl, aralkenyl, acyl, aroyl, aralkoyl, alkanoyl, alkenoyl, alkenaroyl or aralkenoyl group. These acid phosphate esters are water soluble (providing $n$ is 5 or more) and react easily with the amino-acid component to form an adduct. The acid phosphate ester component of the adduct acts as a corrosion inhibitor at the anodic sites on the aluminium.

Although the acid phosphate ester may perform its corrosion inhibiting function when present in less amount than the load-bearing amino acid, it is preferable that the acid phosphate ester should be present in an amount at least equal in weight to the amino-acid and more preferably in an amount about twice the amount of amino acid, so that the amino acid and phosphate ester are present in approximately equivalent proportions. However the adduct of the invention performs its function adequately in the presence of a substantial excess of alkylamine or phosphate ester.

Preferably the amino-acid component is an N-alkyl-β-amino acid, such as N-lauryl-β-amino butyric acid, N-lauryl-β-amino propionic acid or N-decyl-β-amino butyric acid.

In the acid phosphate ester $R_3$ is preferably a straight chain alkyl group and most preferably a lauryl group. The value of $n$ may be 5–250, usually 5–30, and preferably about 9.

The function of the ethylene oxide groups is to solubilise the phosphate ester and the minimum value of $n$ will be determined by the desired content of the selected phosphate ester in the lubricant.

The rolling lubricant provided by the present invention is suitable both for use in cold rolling aluminium strip and in cold rolling aluminium foil. It is unlike existing formulations in three major respects: firstly, it possesses a much higher load-bearing capacity, i.e. it permits greater reductions to be taken without mechanical damage to the strip; secondly, it substantially maintains these properties at contact temperatures of up to 200°C, so that it can be used in sequential rolling passes without the need to reduce the reductions taken, in order to avoid damage to the strip; and thirdly, the lubricant is an aqueous solution rather than, as is normal in aluminium cold rolling, a solution in a light mineral oil base, or an emulsion or dispersion of a light mineral oil and additives in water. Thus it provides a significant advance on existing lubricants because of both its improved load-bearing characteristics and its totally aqueous base, which permits it to provide rapid control of thermal conditions affecting the shape of the rolls and hence of the strip. A further important advantage of a solution-type lubricant is that it avoids the necessity of controlling the particle size of the dispersed phase, which arises with emulsion-type lubricants.

A typical formulation comprises, by weight,
98.0% water,
0.7% N-dodecyl-$\beta$-amino butyric acid,
1.3% acid phosphate ester of a lauryl ethoxylate containing 9 ethylene oxide groups.

Another formulation comprises, by weight,
97.0% water,
1.0% N-dodecyl-$\beta$-amino butyric acid,
2.0% acid phosphate ester of a nonylphenyl ethoxylate containing 9 ethylene oxide groups.

The load-bearing capacity of the second formulation is shown in Table 1 as a function of temperature. Also included, for comparison purposes, are equivalent data for lauryl alcohol and lauric acid in mineral oil-based formulations which are typical of existing conventional lubricants for cold rolling aluminium.

Table 1

| Temperature of Test Piece °C | Load-bearing capacity for | | |
|---|---|---|---|
| | Lubricant of present invention | 5% lauryl alcohol in light mineral oil | 5% lauric acid in light mineral oil |
| 20 | 50.8 | 45.6 | 45.6 |
| 60 | 52.8 | 44.0 | 44.9 |
| 80 | 53.7 | 42.6 | 37.9 |
| 100 | 54.3 | 38.2 | 35.0 |
| 120 | 54.3 | 32.1 | 33.8 |
| 140 | 54.3 | 29.6 | 30.8 |
| 180 | 50.2 | | |

The above results were obtained in a disc compression apparatus. The test consists of compressing under constant load an aluminium which has been lubricated with the sample under test and heated to a selected predetermined temperature. The percentage reduction in the thickness of the aluminium is a measure of the lubricant's load bearing capacity. It should be noted that the results from this test do not show the percentage reduction obtainable in rolling. It serves to compare the properties of lubricants subjected to it, however.

The formulation above quoted has a viscosity in the range of 25–28 secs. Redwood No. 1 at 100°F compared with a viscosity of 30–40 secs. Redwood No. 1 at 100°F, typical of a composition based on a light mineral oil, having a flash point acceptably high to permit its use in the rolling of aluminium. In some instances it may be desirable to add a viscosity improver to raise the viscosity. A polyglycol may be employed for that purpose.

The virtue of the use of the adduct formed by the reaction of the amino-acid and phosphate ester is that it inhibits the formation of white stains on the aluminium strip during subsequent annealing. However, care should be taken to avoid high local concentrations of the lubricant composition on the surface of the aluminium at the commencement of the annealing operation. This may be achieved by the use of a lubricant containment system in conjunction with the rolling mill so that little lubricant is left on the surface on leaving the mill. Alternatively, excess lubricant can be removed by washing the strip in a dilute solution of the lubricant which leaves sufficient quantities of the additive adsorbed on the strip to afford an effective corrosion-inhibiting effect.

Although the amount of foaming experienced with the detailed composition mentioned above is low, it is sometimes desirable to incorporate an anti-foaming agent in addition. A suitable proprietary anti-foaming agent, such as Dow Corning Silicone Emulsion Anti-Foamant RD, marketed by Hopkin & Williams Ltd., may be employed for this purpose.

In cold rolling tests of the lubricant of the present invention using a small pilot rolling mill it was possible to obtain an 80% reduction of 4 mm thick commercial purity aluminium without lubricant breakdown occurring. Similar results were obtained with a number of aluminium alloys, including an alloy containing 4.5% Mg.

The lubricant of the present invention finds utility in other cold working operations for aluminium, such as the drawing and ironing of containers and machining operations (turning, drilling, for example).

It is also found to be useful in the hot and warm rolling of aluminium, where it has the particular advantage as compared with emulsion type lubricants of greater controllability and ease of filtration. For example, using a 2-High mill with 5 inches diameter work rolls, 0.102 inch thick commercial purity aluminium sheet has repeatedly been rolled at temperatures ranging between 250° and 550°C to 0.055 inch, when the resultant surface finish of the aluminium was at least as good as produced by a conventional emulsion-type lubricant in the same operation.

We claim:

1. A lubricant for working aluminium comprising essentially an aqueous solution of a. a secondary alkylamine, in which at least one of the alkyl groups includes a chain of at least 8 carbon atoms, the secondary alkylamine including a carboxylic acid group as a substituent at a carbon atom not more than 3 atoms distant from the amino group and b. an acid phosphate mono- or di-ester of a polyalkylene oxide surface active agent, said alkylamine and said acid phosphate ester each having a solubility of at least ½% by weight in water and said solution including at least ½% by weight of said alkylamine and said acid phosphate ester.

2. A lubricant according to claim 1, in which the secondary alkylamine is an amino-acid of the general formula $R_1$—NN — $R_2$COOH wherein $R_1$ is an alkyl group containing at least 8 carbon atoms and $R_2$ is an alkyl group containing 1–5 carbon atoms.

3. A lubricant according to claim 2 in which $R_1$ is an alkyl group containing one or more hydroxyl groups and/or one or more alkoxy groups.

4. A lubricant according to claim 2 in which the amino-acid is a N-alkyl-β-amino-acid.

5. A lubricant according to claim 4 in which the amino-acid is N-lauryl-β-amino-butyric acid, N-lauryl-β-amino-propionic acid or N-decyl-β-amino butyric acid.

6. A lubricant according to claim 2 in which the ester radical of the acid phosphate mono- or di-ester is in the form $R_3—O(CH_2CH_2O)_n—$, $R_3$ being an alkyl, aryl, aralkyl, alkaryl, alkenyl, alkenaryl, aralkenyl, acyl, aroyl, aralkoyl, alkanoyl, alkenoyl, alkenaroyl or aralkenoyl group and $n$ is 5–250.

7. A lubricant according to claim 6 in which $R_3$ is a nonylphenyl group or a lauryl group and $n$ is 5–30.

8. A lubricant according to claim 7 further characterised in that $n$ is about 9.

* * * * *

UNITED STATES PATENT AND TRADEMARK OFFICE

CERTIFICATE OF CORRECTION

PATENT NO. : 3,966,619

DATED : June 29, 1976

INVENTOR(S) : Gordon Frederick Smith et al.

It is certified that error appears in the above-identified patent and that said Letters Patent are hereby corrected as shown below:

Cover page, first column, item [30], under "Foreign Application Priority Data," "Nov. 5, 1974" should read --Nov. 4, 1974-- .

Signed and Sealed this

Second Day of May 1978

[SEAL]

Attest:

RUTH C. MASON
Attesting Officer

LUTRELLE F. PARKER
Acting Commissioner of Patents and Trademarks